US009084974B2

(12) United States Patent
Beumer et al.

(10) Patent No.: US 9,084,974 B2
(45) Date of Patent: Jul. 21, 2015

(54) PROCESS AND DEVICE FOR MIXING A HETEROGENEOUS SOLUTION INTO A HOMOGENEOUS SOLUTION

(75) Inventors: Tom Beumer, Wr Oss (NL); Wilco Brusselaars, BT Eindhoven (NL)

(73) Assignee: bioMeriéux, S.A., Marcy l'Etoile (FR)

( * ) Notice: Subject to any disclaimer, the term of this patent is extended or adjusted under 35 U.S.C. 154(b) by 679 days.

(21) Appl. No.: 13/497,993

(22) PCT Filed: Sep. 24, 2010

(86) PCT No.: PCT/FR2010/052008

§ 371 (c)(1),
(2), (4) Date: Mar. 23, 2012

(87) PCT Pub. No.: WO2011/039453

PCT Pub. Date: Apr. 7, 2011

(65) Prior Publication Data

US 2012/0182829 A1 Jul. 19, 2012

(30) Foreign Application Priority Data

Sep. 25, 2009 (FR) ..... 09 04580

(51) Int. Cl.

| | |
|---|---|
| ***B01F 11/00*** | (2006.01) |
| *B01F 3/08* | (2006.01) |
| *B01F 3/12* | (2006.01) |

(52) U.S. Cl.

CPC ..... *B01F 11/0002* (2013.01); *B01F 11/0014* (2013.01); *B01F 3/08* (2013.01); *B01F 3/12* (2013.01); *B01F 2215/0037* (2013.01); *B01F 2215/0422* (2013.01)

(58) Field of Classification Search

CPC ..... B01F 11/0002; B01F 11/0014
USPC ..... 366/217, 218
See application file for complete search history.

(56) References Cited

U.S. PATENT DOCUMENTS 3,159,384 A * 12/1964 Davis ..... 366/110
3,199,775 A * 8/1965 Drucker ..... 494/19

(Continued)

FOREIGN PATENT DOCUMENTS

| | | |
|---|---|---|
| EP | 1832335 | 9/2007 |
| FR | 2436624 | 4/1980 |

(Continued)

OTHER PUBLICATIONS

English language abstract of JP2004074130 from espacenet.com, 1 page.

*Primary Examiner* — Tony G Soohoo

(57) ABSTRACT

The present invention relates to a process for mixing a heterogeneous solution containing at least two different liquids and, optionally, at least one solid entity, so as to obtain a homogeneous solution, the process comprising the following steps: a) all or part of the heterogeneous solution is placed in at least one vessel having a longitudinal axis; b) the vessel is positioned on a support driven about a rotation axis, the longitudinal axis being inclined to the rotation axis; and c) the support is made to undergo a movement so as to subject the solution contained in the vessel to successive accelerations and decelerations of sinusoidal intensity, thereby stirring said heterogeneous solution, which becomes homogeneous. The invention also relates to a device for implementing the above process. A preferential application of the invention is in the field of medical diagnostics.

13 Claims, 5 Drawing Sheets

(56) References Cited

U.S. PATENT DOCUMENTS

| | | | | | |
|---|---|---|---|---|---|
| 3,850,580 | A * | 11/1974 | Moore et al. | 422/500 |
| 3,975,001 | A * | 8/1976 | Moore et al. | 366/111 |
| 4,555,183 | A * | 11/1985 | Thomas | 366/208 |
| 4,848,917 | A * | 7/1989 | Benin et al. | 366/208 |
| 4,943,164 | A * | 7/1990 | Ohishi et al. | 366/149 |
| 5,183,638 | A * | 2/1993 | Wakatake | 422/64 |
| 5,352,037 | A * | 10/1994 | Jouvin | 366/219 |
| 5,551,779 | A * | 9/1996 | Gantner et al. | 366/217 |
| 5,921,676 | A | 7/1999 | Reynolds et al. | |
| 6,733,170 | B2 * | 5/2004 | Mukasa et al. | 366/139 |
| 7,201,512 | B2 * | 4/2007 | Suzuki et al. | 366/217 |
| 7,507,015 | B2 * | 3/2009 | Wang | 366/217 |
| 8,827,540 | B2 * | 9/2014 | Schafrinski et al. | 366/111 |
| 2002/0172091 | A1 * | 11/2002 | Hatakeyama | 366/144 |
| 2003/0067838 | A1 * | 4/2003 | Schmidt | 366/219 |
| 2003/0107949 | A1 * | 6/2003 | Huckby et al. | 366/217 |
| 2003/0179646 | A1 * | 9/2003 | Miller | 366/217 |
| 2003/0198126 | A1 * | 10/2003 | Flackett | 366/217 |
| 2003/0214878 | A1 * | 11/2003 | Huckby | 366/217 |
| 2004/0085855 | A1 * | 5/2004 | Midas et al. | 366/209 |
| 2006/0109739 | A1 * | 5/2006 | Huckby | 366/208 |
| 2006/0109740 | A1 * | 5/2006 | Huckby | 366/208 |
| 2006/0177936 | A1 | 8/2006 | Shneider et al. | |
| 2007/0002680 | A1 * | 1/2007 | Vanderbilt et al. | 366/217 |
| 2007/0002681 | A1 * | 1/2007 | Vanderbilt et al. | 366/217 |
| 2007/0002682 | A1 * | 1/2007 | Vanderbilt et al. | 366/217 |
| 2007/0025180 | A1 * | 2/2007 | Ishii | 366/139 |
| 2007/0247967 | A1 * | 10/2007 | Johnson et al. | 366/217 |
| 2007/0280038 | A1 * | 12/2007 | Schmidt et al. | 366/139 |
| 2008/0087352 | A1 * | 4/2008 | Malanowicz et al. | 141/2 |
| 2008/0151685 | A1 * | 6/2008 | Wang | 366/217 |
| 2009/0229465 | A1 * | 9/2009 | Takahashi | 95/258 |
| 2009/0281663 | A1 * | 11/2009 | Robida | 700/265 |
| 2010/0265791 | A1 * | 10/2010 | Ishii | 366/223 |
| 2012/0106288 | A1 * | 5/2012 | Harada | 366/75 |
| 2012/0182829 | A1 * | 7/2012 | Beumer et al. | 366/218 |
| 2014/0092706 | A1 * | 4/2014 | Ishii, Hiroshige | 366/218 |

FOREIGN PATENT DOCUMENTS

| | | |
|---|---|---|
| GB | 2033771 | 5/1980 |
| GB | 2062481 | 5/1981 |
| JP | 2004074130 | 3/2004 |
| WO | 2009137480 | 11/2009 |

* cited by examiner

PROCESS AND DEVICE FOR MIXING A HETEROGENEOUS SOLUTION INTO A HOMOGENEOUS SOLUTION

CROSS REFERENCE TO RELATED APPLICATIONS

This application is the national stage application under 35 USC §371 of International Application No. PCT/FR2010/052008, filed Sep. 24, 2010, which claims the benefit of French Patent Application No. 0904580, filed Sep. 25, 2009, the disclosures of which are hereby incorporated by reference.

The present invention relates to a process for mixing a heterogeneous solution containing a liquid and a solid entity or at least two different liquids and, optionally, a solid entity so as to obtain a homogeneous solution, in which process the heterogeneous solution is placed in a vessel. The process is particularly advantageous as it proposes the combination of a circular or non-circular orbital movement of the vessel having an axis of symmetry which is itself inclined to the gravitational direction.

The invention also provides a device for implementing such a process.

The treatment of liquid chemicals or biological specimens in laboratories requires that these liquids be mixed together and/or mixed with compounds in order to carry out various reactions, especially detection reactions. It is therefore important for the mixing of these various mixtures in a vessel to be optimal in order for the reaction to be able to take place. Mixing will be all the more difficult to achieve when the solutions containing the biological specimens or the reactive compounds have:

different densities; and/or
various viscosities; and/or
very different mutual miscibilities;
small solution volume;
etc.

Furthermore, a mixture must not be made with a too violent force, which could create an undesirable suspension of the solutions to be mixed, either by centrifugation, with phase separation, or in aerosol or emulsion form, which may cause, for example if nucleic acids are being treated, cross contaminations prejudicial to a reliable subsequent diagnostic operation. Finally, in certain cases, a mixture must be made within a defined period of time so as to prevent the solutions to be mixed from undergoing temperature variations or to prevent a side reaction taking place.

The mixing techniques used in laboratories are relatively complicated to implement.

One of the mixing techniques consists, during addition of a second solution to a first solution present in a vessel, in alternately carrying out, several times, a pick-up from, followed by a delivery into, the vessel using a cone through the action of the piston of a pipette. The drawback of this method is that it requires a certain dexterity and delicacy on the part of the user when implementing it. The repetitivity of such an operation is also doubtful, depending on the user and his state of fatigue, nervousness, etc. Specifically, too high a pick-up/delivery frequency due to poor positioning of the cone in the vessel may cause air bubbles to appear within the mixture. Furthermore, if delivery is carried out at high speed, the volume will then be ejected with too high a force, thereby increasing the risk of splashes by ricocheting against the wall of the vessel and the risk of certain droplets possibly being removed therefrom. This may result in a loss in the amount of solution to be mixed. Moreover, this loss may also be the result of an incomplete delivery phase during which the user does not fully actuate the piston for expelling the liquid from the cone. Moreover, this technique does not allow high-viscosity solutions to be mixed. Finally, repeatedly inserting the cone into the medium to be mixed considerably increases the risk of introducing contaminants.

One very common laboratory technique for making a mixture consists in generating a vortex, through what is called a "vortexing" action, immediately after the two solutions have been introduced into a vessel. U.S. Pat. No. 4,555,183 describes an apparatus for implementing this technique. The apparatus makes it possible, when contact is made between the tube and the rotor housing, to turn the motor on and drive the rotor at very high rotation speeds. The solutions contained in the tube undergo rotation and an ascensional movement, together creating a vortex that enables the solutions to be mixed together. However, this technique has the following two major drawbacks. Firstly, when the user withdraws the tube from the rotor housing, the vortex ceases and one portion of the solutions drops back down under gravity while the other portion of the solutions remains in contact with the internal walls of the tube, wetting them over a height corresponding to the height of the vortex. It is therefore necessary to carry out an additional centrifugation step in order to recover that portion of the solutions in contact with the internal walls of the tube. Moreover, this technique does not allow two immiscible solutions to be mixed independently of each other since, owing to the high rotation speed, an emulsion in the form of droplets of one solution in the other is created. However, in certain cases this emulsion is undesirable. This is because when a biological specimen is prepared, for example for an amplification reaction, the enzymes, buffers and other reactants useful for the amplification reaction are added to the biological specimen together with a small volume of oil. This volume of oil covers the amplification mixture and prevents the amplification reactants from evaporating during the various heating cycles over the course of amplification. To obtain a good amplification yield, it is necessary for the various reactants of the aqueous phase to be fully mixed without destroying the protective oil film. However, by applying the technique described in U.S. Pat. No. 4,555,183 to a mixture for an amplification reaction, because of the high rotation speeds, the oily phase mixes with the aqueous phase creating an emulsion that will prevent the enzyme from acting.

The prior art U.S. Pat. No. 5,921,676 also discloses a mixing technique employing a mixing device comprising a platform that undergoes a horizontal and/or vertical orbital movement. This apparatus serves for mixing large or moderately large volumes, i.e. of the order of a millilitre. However, it does not allow volumes of less than a millilitre to be effectively mixed. This is because as long as the diameter of the vessel containing the solutions to be mixed is greater than the diameter of the orbital movement, the mixing of the solutions will be effective. The centre of the vessels travels an orbital distance equivalent to the orbital distance of the platform, thus generating centrifugal forces in the liquid which change diametrically in direction at each half-rotation and allow the solutions to be mixed. However, when the diameter of the vessel is smaller than the diameter of the orbital movement, which is the case for example for Eppendorf® tubes, the solutions are subjected to centrifugal forces which push them against the wall throughout the duration of the orbital movement. There are no constraints for changing the direction of the centrifugal forces, and therefore mixing cannot take place, these solutions following the same path as the platform on which the vessel is placed. In addition, the repetitivity of the movement is entirely hypothetical.

Document FR-A-2.436.624 relates to an apparatus for mixing a fluid substance in a vessel, comprising: a first vessel support means enabling the vessel to rotate about a first axis; a second vessel support means, enabling the vessel to rotate about a second axis which is not perpendicular to the first axis; a first drive means which is connected to said second support means in order to rotate the vessel about said second axis; and a second drive means which is connected to said first support means in order to rotate the vessel about said first axis while the vessel is rotating about said second axis. The problem with this type of apparatus is that the two rotation axes always intersect. There is therefore a region near this point of intersection that undergoes practically no movement—there will therefore be differential mixing between points closest to and points furthest away from this point of intersection and therefore inhomogeneous mixing within the liquid or liquids.

In addition, the devices of the prior art are not capable of mixing small volumes of heterogeneous solutions into a homogeneous solution, while preventing emulsions and/or aerosols from forming (with the risk of contamination in the medical field for example) and preventing all the walls of the vessel from being wetted. There is therefore still a need for a new mixing device that overcomes the drawbacks of those of the prior art.

To fulfil this need, the Applicant proposes a novel device for mixing heterogeneous solutions so as to obtain a homogeneous solution. By virtue of the device according to the invention, the solutions contained in the vessel undergo successive accelerations and decelerations, the sinusoidal intensity of which allows the solutions to be gently agitated while preventing all of the walls of the vessel from being wetted and/or preventing the phases of the various solutions from being dispersed. This device also makes it possible to dispense with a centrifugation step after mixing.

The term "heterogeneous solution" in the context of the present invention is understood to mean at least two liquids or fluids that are miscible in aqueous phase and have different properties and viscosities. These fluids may contain solid entities or particles in suspension. These liquids and optionally the solid entities that are contained in these liquids are distributed non-uniformly and irregularly in the vessel that contains them.

The term "homogeneous solution" in the context of the present invention is understood to mean a solution, the constituents of which are distributed uniformly and regularly in the vessel that contains them.

The term "mixing" in the context of the present invention is understood to mean combining, in a vessel, at least two liquids having different properties so that they form only a single liquid, the constituents of which are distributed uniformly and homogeneously.

At least one liquid may also be associated with at least one type of solid entity or particle in suspension. The terms "disperse" and "homogenize" may be employed without distinction in place of the term "mix".

The term "solid entities" in the context of the present invention is understood to mean particles which may be latex particles, glass (CPG) particles, silica particles, polystyrene particles, agarose particles, sepharose particles, nylon particles, etc. These materials may possibly allow magnetic matter confinement and may also form a filter, a film, a membrane or a strip. These materials are well known to those skilled in the art.

The term "rotation" in the context of the present invention defines a planar movement of a body in which all the points of the body describe paths having the same geometric shape but different centres, the centres being mutually parallel during the movement. The path may take the form of a circle, the body undergoing a rotary translation. According to another embodiment of the invention, the path may be elliptical, the body undergoing an elliptical translation. For example, if the body is an Eppendorf® tube positioned initially in the following manner: the end of the cap is at a distance L1 from the axis of the rotation movement (called the position closest to the axis) and the end of the bottom of the tube lies at a distance L2 from the axis of the rotation movement (called the position furthest away from the axis). When the rotation movement takes place about its axis, the end of the cap and the end of the bottom form a segment that moves in a parallel fashion about this axis, the segment describing for example a circular path. When the segment has travelled a distance of a quarter of a circle, the end of the cap and the end of the bottom lie at the same distance L3 from the axis of the movement. When the segment has travelled a distance of a semicircle from the initial position, because of this parallel displacement of the segment, the end of the cap lies at a distance L2 from the axis of the movement and the end of the bottom of the tube lies at the distance L1 from the axis of the movement. Thus, that portion of the tube initially closest to the axis is found in the position furthest away from this axis after a half-rotation, and vice versa.

The expression "sufficient volume of air" denotes a portion of a space in the vessel occupied by air, enabling free displacement of the liquids inside the vessel during the rotation movement.

The expression "substantially vertical position" in the present invention means any position that varies from a gravitational direction by an angle of between 0° and ±2°.

The present invention relates to a process for mixing a heterogeneous solution containing at least two different liquids and, optionally, at least one solid entity, so as to obtain a homogeneous solution, the process comprising the following steps:

a) all or part of the heterogeneous solution is placed in at least one vessel having a longitudinal axis;
b) the vessel is positioned on a support driven about a rotation axis, the longitudinal axis being inclined to the rotation axis; and
c) the support is made to undergo a movement so as to subject the solution contained in the vessel to successive accelerations and decelerations of sinusoidal intensity, thereby stirring said heterogeneous solution, which becomes homogeneous.

This process may also apply to the mixing of a heterogeneous solution containing at least one liquid and at least one solid entity.

According to a variant embodiment of the process, during step c), the movement of the support on which said vessel stands enables that part of the vessel closest to said rotation axis to be found in the position furthest away from this axis after a half-rotation and that part of the vessel furthest away from the rotation axis to be found in the position closest to said axis after a half-rotation.

Whatever the embodiment, during the movement of the support, the longitudinal axis of the vessel cuts the rotation axis of said support twice per rotation turn.

Whatever the embodiment, the vessel contains, apart from the heterogeneous solution, a volume of air sufficient to allow stirring without all or part of said heterogeneous solution being able to leave said vessel during mixing.

According to a variant of the embodiment of the preceding paragraph, the vessel contains, apart from the heterogeneous solution, a volume of air sufficient to allow stirring and is closed by a stopper so that all or part of said heterogeneous solution cannot leave said vessel during mixing.

Whatever the embodiment, the angle of inclination of the longitudinal axis of the vessel varies according to the rotation speed and/or according to the position of said vessel during rotation.

Whatever the embodiment described above, the movement of the support is circular.

According to a variant of the embodiment of the preceding paragraph, the movement of the support is elliptical.

The present invention also relates to a device for mixing a heterogeneous solution containing at least two different liquids and, optionally, at least one solid entity, or else containing at least one liquid and at least one solid entity, so as to obtain a homogeneous solution, which consists of:

i. a static frame which may, optionally, be placed on a table or any other surface;
ii. a moveable support that can receive at least one vessel having a longitudinal axis;
iii. a motor drive means fastened to the frame and capable of generating a rotational movement; and
iv. a transmission means for transmitting the rotational movement of the motor drive means to the moveable support, so as to subject the solution contained in the vessel to successive accelerations and decelerations of sinusoidal intensity.

According to one embodiment of the device, the action of the transmission means positions the vessel so that the part of the vessel closest to the rotation axis is found in the position furthest away from this axis after a half-rotation and that the part of the vessel furthest away from the rotation axis is found in the position closest to said axis after a half-rotation.

Whatever the embodiment of the device, the rotation axis of the support is in a substantially vertical position and the longitudinal axis of the vessel is not in a substantially vertical position.

Whatever the embodiment, the longitudinal axis of the vessel is at an angle of inclination to the rotation axis of the support and, when the two axes intersect, the angle is between 1° and 60°, preferably between 20° and 50° and even more preferably between 25° and 45°.

Whatever the embodiment, the vessel is closed.

The method that we have developed suffers from none of the aforementioned drawbacks. The advantages of the invention over the mixing methods currently available are:

1. only a limited region of the internal surface of the vessel is wetted;
2. a wider range of orbital frequencies and amplitudes may be used instead of a closely defined oscillation amplitude/frequency combination;
3. a relatively wide range of angles between the longitudinal axis of the container and the rotation axis is used, facilitating the optimization of these parameters, by being simpler and more flexible to use;
4. the method allows liquids, and thus the mixture, to move sufficiently gently and smoothly in order for the risk of forming aerosols to be much less critical, or even nonexistent, than in the case of vortex mixing or orbital mixing, as described in the prior art; and
5. it thus allows effective mixing even when the vessel is not closed and greatly reduces the risks of contamination.

The mixer according to the invention essentially uses a known "orbital" mixing device, but instead of placing the tube with its axis of symmetry parallel to the rotation axis we place the axis of symmetry of the tube at an angle, so as to be not parallel with the rotation axis of the device and with the gravitational direction.

The improvement in mixing performance is achieved for any angle greater than 0 (0 being equivalent to two parallel axes). Of course, this angle may vary according to the specific combinations used, being based on:

the shape of the vessel or tube; and
the properties of the liquids to be mixed, for which limited angle ranges may be necessary.

The method may be used with reaction vessels of practically any shape and is most advantageous in those cases in which conventional, orbital oscillation or vortex, methods are not suitable.

The examples and figures appended represent particular embodiments but cannot be considered as limiting the scope of the present invention:

Figure 4:
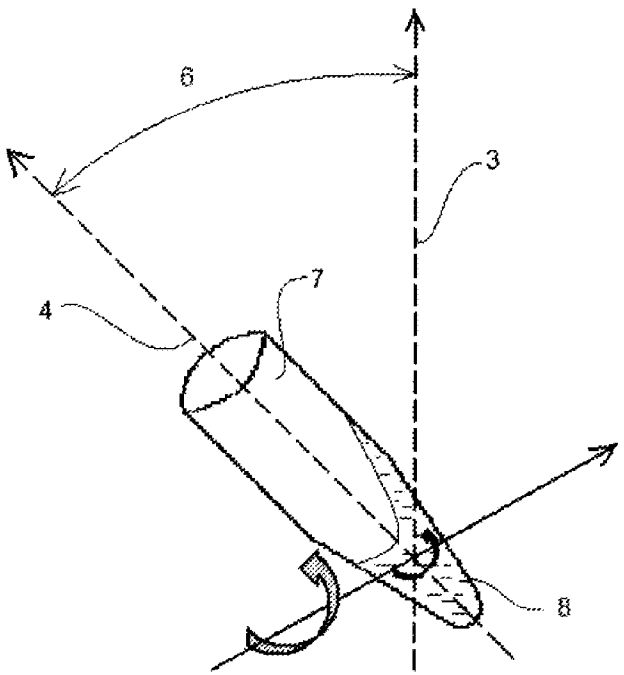
Figure 3:
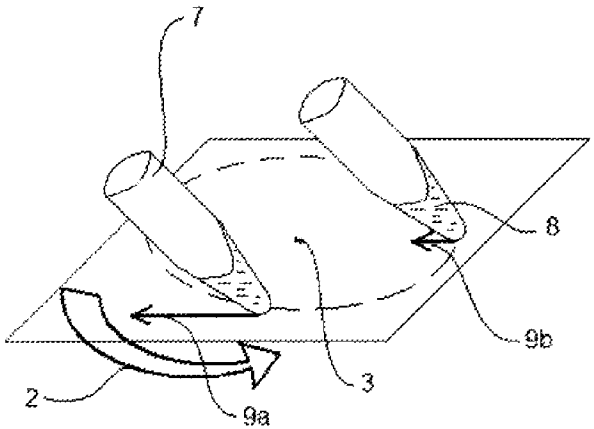
Figure 6A:
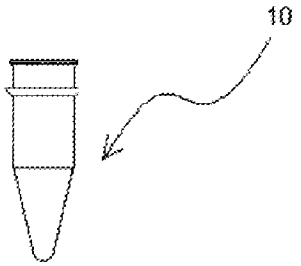
Figure 6B:
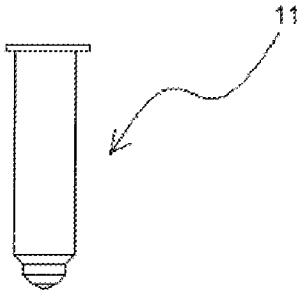
Figure 7:
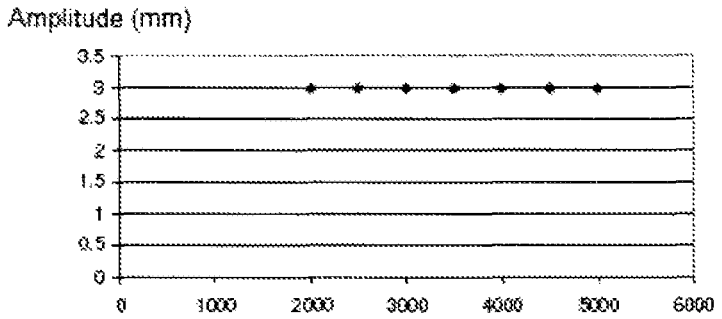
Figure 8:
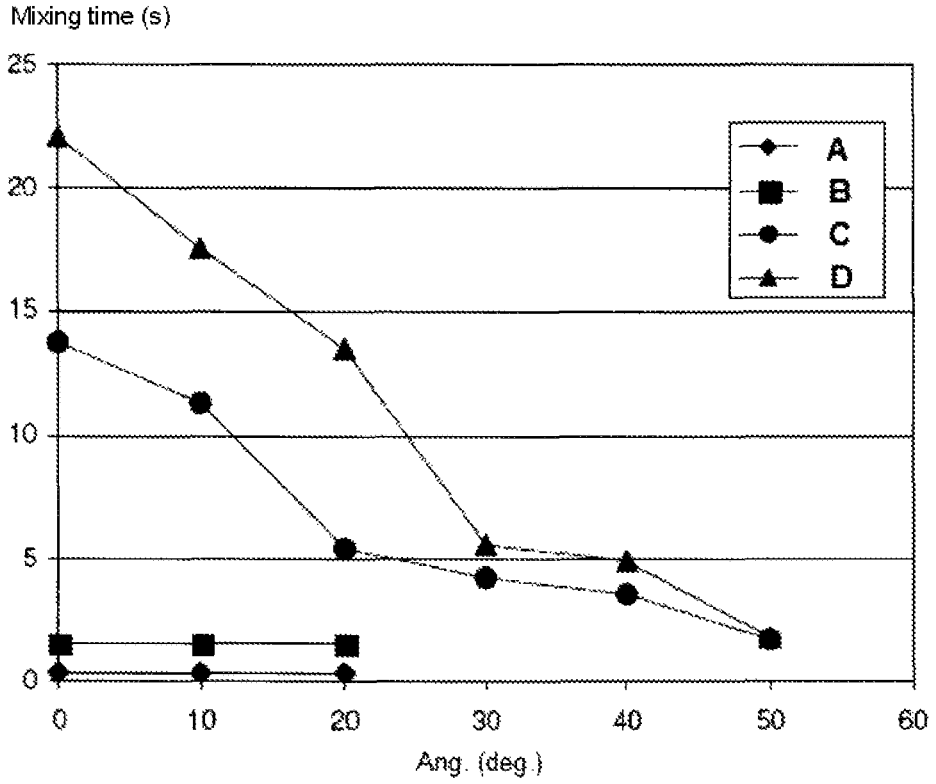
Figure 9:
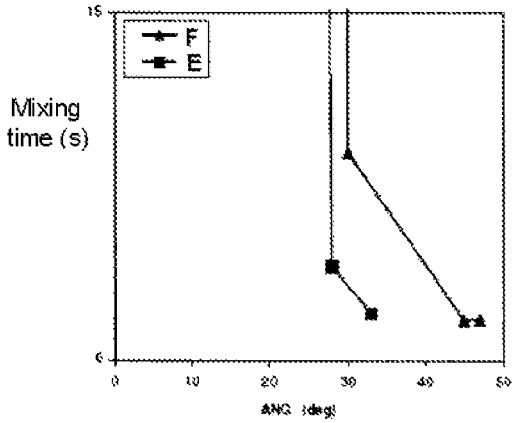
Figure 10:
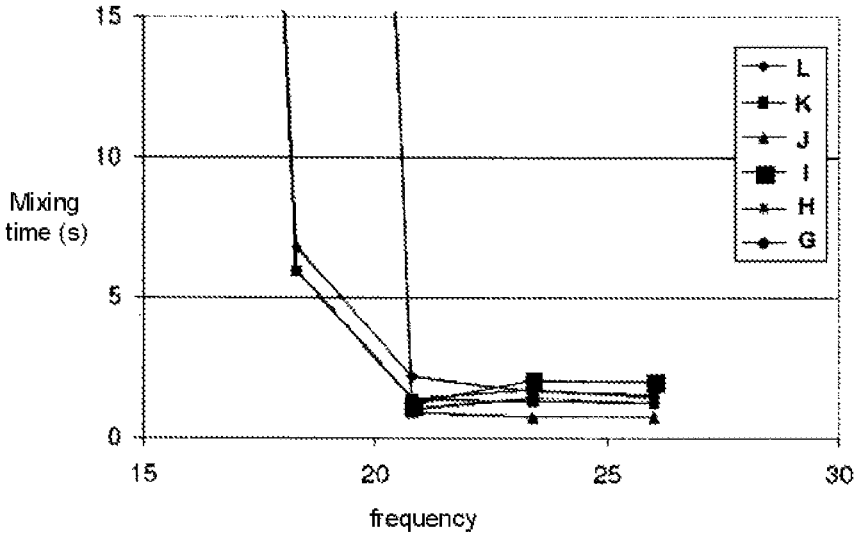

FIG. 3 demonstrates the vessel in two different positions of its movement when it is actuated by the orbital mixer according to the invention and also the intensity of the forces that are applied to the liquid;

FIG. 4 provides a representation of the largest movement undergone by the liquid during the deceleration shown in FIG. 3;

FIG. 5 shows the main liquid flows that improve the mixing during rotation of the mixer;

FIG. 6 shows two different types of vessel used by the inventors;

FIG. 7 is a graph of the orbital rotation amplitude, expressed in millimetres (mm), plotted on the y-axis as a function of the motor speed, which corresponds to the frequency in revolutions per minute, shown on the x-axis;

FIG. 8 is a graph of the mixing time (MT, expressed in seconds) for achieving homogeneity with a cylindrical vessel according to FIG. 6*b*, plotted on the y-axis as a function of the angle of inclination of the vessel, measured in degrees relative to the vertical, shown on the x-axis;

FIG. 9 is a graph of the mixing time in seconds (MT(s)), for achieving homogeneity with an Eppendorf® vessel according to FIG. 6, plotted on the y-axis as a function of the angle of inclination of the vessel, measured in degrees (Ang. (deg.)), shown on the x-axis; and FIG. 10 shows a graph of the mixing time in seconds, for achieving homogeneity with a cylindrical vessel according to FIG. 6*b*, plotted on the y-axis as a function of the frequency of the rotation movement of the cylindrical vessel, which has a fixed angle of inclination of 45° to the vertical, shown on the x-axis for various concentrations of a viscous product and with and without an oil film.

OPERATING PRINCIPLE

Figure 1:
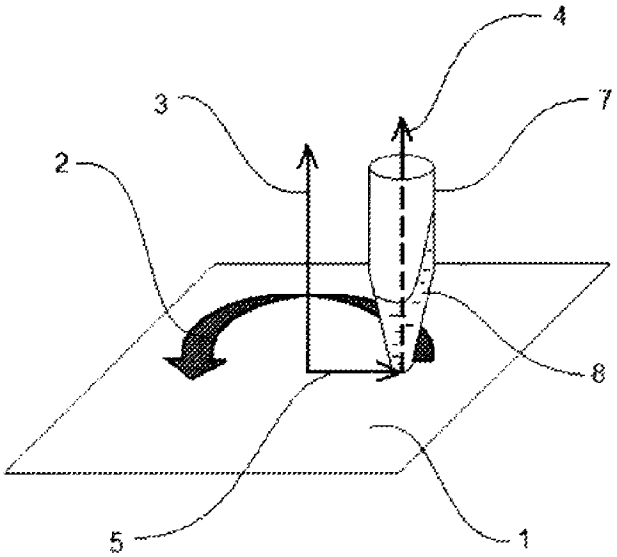
FIG. 1 shows an orbital mixer according to the prior art.

The Normal Mechanical Arrangement for Orbital Movement:

The normal mechanical arrangement for orbital movement as means for mixing liquids, is shown in FIG. 1. This shows a solid support, for example a horizontal table 1, and confined movements in small circles or rotations 2 having a radius 5 and an axis of symmetry/rotation 3 of the table 1, preferably parallel to the gravitational direction. Each vessel 7, the contents of which have to be mixed, is placed vertically on said table 1 with the axis of symmetry 4 of said vessel parallel to the rotation axis 3. This same geometry is used for the orbital mixers of the prior art that the Applicant has identified.

In this geometry, the mechanism works so as to generate a vortex. Thus the liquid (in fact the two liquids that it is desired to mix together, but for practical reasons we will use the singular noun hereafter) is accelerated and, in an oscillatory movement, starts to move synchronously along the vertical wall of the vessel with the centre of gravity of the liquid to the outside of the orbit.

Basic supposition of this methodology is that the liquid is in fact forced to undergo an oscillating movement, which requires a mixer amplitude/frequency combination that corresponds to the combination of the diameter and liquid properties, such as viscosity, density and surface tension. With non-cylindrical reaction vessels, which are often used in molecular biology, it may be assumed that there is no single amplitude/frequency combination which is optimum: for a fixed amplitude, the narrow bottom portion requires higher frequencies than the wider upper portion of the vessel. This is perfectly illustrated during experimentation, which shows that mixing is not completely achieved in the narrowest portion of the vessel, the dyeing by the tracer being absent.

One solution for improving this mixing would be simple, but it suffers from a number of drawbacks. Thus, the frequency of the orbital movement has to be increased to such an extent that, independently of the content of the vessel, the liquid is mixed. A key drawback of this approach is that inevitably the stopper, which closes off said vessel, is wetted, with a loss of liquid prejudicial in the field of medical diagnostics. Furthermore, if a thin oil film were to be present on the liquid, the mixing with aqueous liquids would result in an emulsion which it is obviously desirable to avoid.

For this reason, we have found a different way of using the orbital mixer. Instead of seeking a way of introducing the vortex, we decided to seek another model for moving the liquids that induces mixing.

Figure 2:
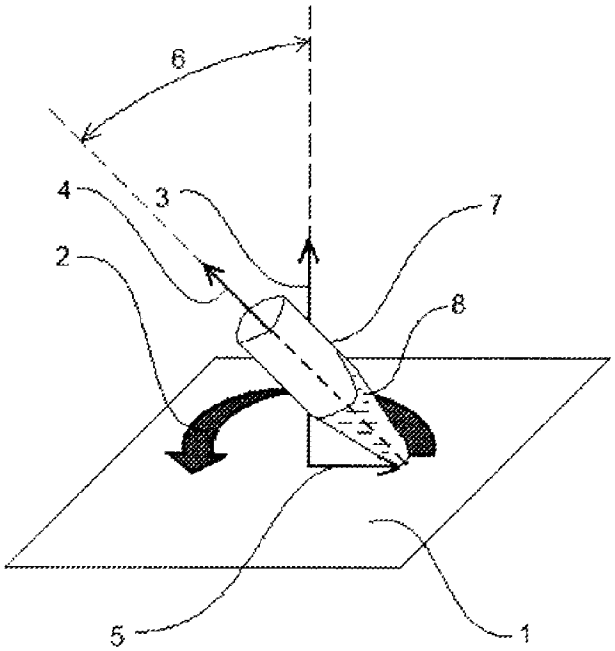
FIG. 2 shows a mixer according to the present invention.

Preferred Geometry of the Mixing Device:

Instead of placing the vessel 7 with its axis of symmetry 4 parallel to the rotation axis 3 of the mixer 9, we placed said vessel 7 at a certain angle 6, as is clearly shown in FIG. 2.

Upon application, an orbital mixer 9 according to the invention is used, in which the vessel 7 containing the liquid 8 to be mixed is placed at an angle 6 to the rotation axis 3, which is itself parallel to the gravitational direction. Moreover, and as shown in FIG. 3, the angle of inclination of the vessel 7 to the horizontal or to the vertical is still the same for an external observer in a lateral position. In other words, an observer in this position will have the sensation that the vessel 7 is moving alternately to the left and to the right, and vice versa, said vessel 7 remaining at a constant angle of inclination.

Figure 5A:
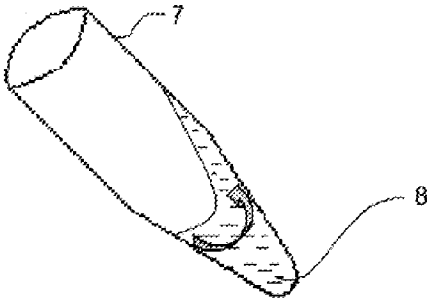
Figure 5B:
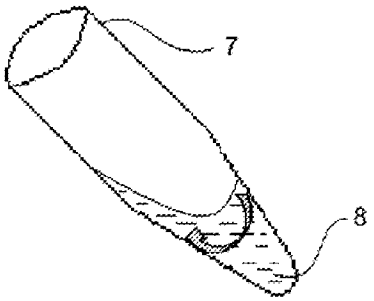

Visual inspection of the contents of the vessel 7, using a high-speed video camera, clearly shows two pronounced differences between the conventional orbital mixing and this angular mixing mode:

1. without moving, the symmetry of the liquid surface is lost and the circumference of the meniscus and the angle of contact differ with the angle of the vessel 7; and
2. with movement along the arrow 2 of support 1, the movement of the surface of the liquid 8 then resembles that of waves and, using a tracer dye to follow the spatial redistribution thereof during mixing, it is easy to observe a liquid movement as shown in FIGS. 5*a* and 5*b*, according to the difference in rotation orientation.

It is the combination of the asymmetrical distribution of the liquid 8, the increased surface area of said liquid 8, and the sinusoidal acceleration, changing with true accelerations along the arrow 9*a* and decelerations along the arrow 9*b* (FIG. 3), which facilitates the flow, the reflux and therefore the mixing. These accelerations along the arrow 9*a* and decelerations along the arrow 9*b* correspond to the movements observed in FIGS. 5*b* and 5*a* respectively. Instead of forming a vortex, as is the case in conventional orbital mixing within the liquid, and of finding the liquid coated on the internal surface of the vessel 7, this method keeps the liquid grouped together as much as possible, while still balancing it sufficiently so that the liquid laying at the bottom of said vessel 7 also undergoes movement. The internal movement of the liquid is in fact a rotation about an axis perpendicular to the other two axes, namely the gravitational direction and the axis of symmetry 4 of the vessel 7.

EXAMPLES

1—Operating Mode:

We used and tested two vessels or tubes having different geometrical shapes, firstly an Eppendorf® tube 10 (FIG. 6*a*) and then a more conventional tube, namely the cylindrical tube 11 (FIG. 6*b*). The tubes used in these experiments therefore had a maximum inside diameter of 5 millimetres (mm). Moreover:

1. three different fluids of increasing viscosity, containing either 0, or 1M or 1.5M sorbitol, were used,
2. with, for each concentration, the presence or absence of oil on the aqueous phase; and
3. with an aqueous dye solution added between the oil and the solution, containing sorbitol.

The aim was therefore to examine:

1. at what angle of inclination the mixing is improved;
2. within what frequency ranges the mixing is improved; and
3. what the effect of the viscosity and/or that of the oil film is on the mixing time.

The quality of the mixing was judged visually using high-speed video images, recorded at 200 images per second, providing a time resolution of approximately 5 milliseconds (ms).

2—Impact of the Shape of the Vessel, the Viscosity of the Liquid and the Presence or Absence of an Oil Film:

For a fixed amplitude of the device 9, the amplitude of the table 1 was always constant irrespective of the rotation speed setting. This is clearly shown in FIG. 7, with the orbital rotation amplitude plotted on the y-axis as a function of the motor speed (which corresponds to the frequency) on the x-axis.

FIG. 8 therefore shows the reduction in the time needed to mix the liquid, by changing the angle of the cylindrical tube between 0° (as per usage with conventional orbital mixing) and values up to 50°.

In FIG. 8, a cylindrical tube 11 of constant radius was used. In this case, quite small amounts of low-viscosity liquid were mixed even at angles close to zero. However, if the viscosity and/or the volume increase(s) or when the oil is added, the zero-degree mixing becomes much more difficult. Using 60 μl of aqueous liquid in a cylindrical tube 11, the improvement in mixing is detectable even at small angles (FIG. 8). Even small changes help to reduce the mixing time, but it may be seen that the best performance is obtained for angles of greater than 20° and even for larger angles, the mixing time being reduced to levels close to the shortest mixing times for small volumes.

This means that in a cylindrical tube 11, the liquids that cannot be mixed at 0° can be perfectly mixed at angles exceeding 0°, with optimized mixing times approaching those of liquids similar to water at 0°.

The angle for the best mixing performance depends on the volume of the vessel and increases characteristically with the viscosity of the liquid 8 (or fluid), and depends on the presence of oil on the aqueous liquid. At angles exceeding approximately 30°, most of the configurations examined allowed mixing in a few seconds, in general 5 seconds. It should be noted that this proved to be the case for a liquid containing:

only 40 μl of water ($H_2O$=curve A), or

40 μl of water with oil ($H_2O$+OIL=curve B) or

60 μl of 1.5M sorbitol (SORB.=curve C) or finally

60 μl of 1.5M sorbitol with oil (SORB.+OIL=curve D).

3—Impact of the Shape of the Vessel and the Presence of an Oil Film:

According to FIG. 9, the effect of the angle of the tube 11 with respect to the mixing time was studied in the case of two stratified liquids, namely two aqueous liquids of different viscosities (2 mPa.s (millipascals per second) corresponding to curve E and 20 mPa.s corresponding to curve F) that are covered with an oil film.

In this case, by optimizing the angle of the vessel 10, which was in the form of a conical Eppendorf® tube, we found that there is a sharper transition between slow mixing and rapid mixing when an oil film is used in addition to the liquid. In this case at an angle of between 28° and 30°, and also at larger angles, the mixing time is considerably reduced. In fact, the higher the aqueous viscosity, the higher the angle must be, but in the present case when the viscosity is increased (by increasing the amount of oil tenfold: 2 mPa.s for the curve indicated by squares and 20 mPa.s for the curve indicated by triangles), increasing the angle from 28° to 30° makes it possible to achieve a good mixing result.

4—Impact of the Viscosity and the Presence of an Oil Film of Constant Shape and Angle of Positioning for the Vessel:

In the case of FIG. 10, and considering the frequency that has to be applied for cylindrical vessels 11 having an angle of 45° and that was chosen for its capability allowing good mixing, the optimum frequency is more than 20 Hz. This frequency depends on the geometry of the tube and must therefore be optimized for each configuration. This effect of the frequency (in rpm) of the vessel on the mixing time for "simple" liquids with increasing viscosity was obtained with three stratified aqueous liquid systems of three different viscosities covered or not covered with an oil film:

40 μl of water (OM) corresponding to the curve indicated by small circles (curve G);

40 μl of water (1M) with 1M sorbitol corresponding to the curve indicated by crosses (curve H);

40 μl of water (1.5M) with 1.5M sorbitol corresponding to the curve indicated by large squares (curve I);

40 μl of water and oil (OM+OIL) corresponding to the curve indicated by triangles (curve J);

40 μl of water and oil (1M+OIL) with 1M sorbitol for the curve indicated by small squares (curve K);

40 μl of water and oil (1.5M+OIL) with 1.5M sorbitol for the curve indicated by diamonds (curve L).

REFERENCES

1. Solid support or table
2. Rotational movement of the vessel 7 on the support 1
3. Rotation axis of the mixer
4. Axis of symmetry of the vessel 7
5. Radius of the rotation
6. Angle between the rotation axis 3 and the axis of symmetry 4
7. Vessel containing the liquid 8
8. Liquid contained in the vessel 7
9. Mixer device
10. Eppendorf® tube
11. Conventional cylindrical tube

The invention claimed is:

1. A process for mixing a heterogeneous solution containing at least two different liquids and, optionally, at least one solid entity or else containing at least one liquid and at least one solid entity, so as to obtain a homogeneous solution, the process comprising the following steps:

a) all or part of the heterogeneous solution is placed in at least one vessel having a longitudinal axis;

b) the vessel is positioned on a support driven about a rotation axis, the longitudinal axis being inclined to the rotation axis; and c) the support is made to undergo a movement enables that part of the vessel closest to said rotation axis to be found in the position furthest away from this axis after a half-rotation and that part of the vessel furthest away from the rotation axis to be found in the position closest to said axis after a half rotation, so as to subject the solution contained in the vessel to successive accelerations and decelerations of sinusoidal intensity, thereby stirring said heterogeneous solution, which becomes homogeneous.

2. The process according to claim 1, characterized in that, during the movement of the support, the longitudinal axis of the vessel intersects the rotation axis of said support twice per rotation turn.

3. The process according to claim 1, characterized in that the vessel contains, apart from the heterogeneous solution, a volume of air sufficient to allow stirring without all or part of said heterogeneous solution being able to leave said vessel during mixing.

4. The process according to claim 1, characterized in that the vessel contains, apart from the heterogeneous solution, a volume of air sufficient to allow stirring and is closed by a stopper so that all or part of said heterogeneous solution cannot leave said vessel during mixing.

5. The process according to claim 1, characterized in that the angle of inclination of the longitudinal axis of the vessel varies according to the rotation speed and/or according to the position of said vessel during rotation.

6. The process according to claim 1, characterized in that the movement of the support is circular.

7. The process according to claim 1, characterized in that the movement of the support is elliptical.

8. A device for mixing a heterogeneous solution containing at least two different liquids and, optionally, at least one solid entity, or else containing at least one liquid and at least one solid entity, so as to obtain a homogeneous solution, which consists of:

i. a static frame which may, optionally, be placed on a table or any other surface;

ii. a moveable support that can receive at least one vessel having a longitudinal axis;

iii. a motor drive means fastened to the frame and capable of generating a rotational movement; and iv. a transmission means for transmitting the rotational movement of the motor drive means to the moveable support, characterized in that the action of the transmission means positions the vessel so that the part of the vessel closest to the rotation axis is found in the position furthest away from this axis after a half-rotation and that the part of the vessel furthest away from the rotation axis is found in the position closest to said axis after a half-rotation, so as to subject the solution contained in the vessel to successive accelerations and decelerations of sinusoidal intensity.

9. The device according to claim 8, characterized in that the rotation axis of the support is in a substantially vertical position and in that the longitudinal axis of the vessel is not in a substantially vertical position.

10. The device according to claim 8, characterized in that the longitudinal axis of the vessel is at an angle of inclination to the rotation axis of the support and in that, when the two axes intersect, the angle is between 1° and 60°.

11. The method according to claim 1, characterized in that the vessel is closed.

12. The device of claim 10, wherein when the two axes intersect, the angle is between 20° and 50°.

13. The device of claim 10, wherein when the two axes intersect, the angle is between 25° and 45°.

* * * * *